US008162066B2

(12) United States Patent
Farmer et al.

(10) Patent No.: US 8,162,066 B2
(45) Date of Patent: Apr. 24, 2012

(54) TUBING WEIGHT OPERATION FOR A DOWNHOLE TOOL

(75) Inventors: Jack D. Farmer, Dickenson, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 178 days.

(21) Appl. No.: 12/277,444

(22) Filed: Nov. 25, 2008

(65) Prior Publication Data

US 2010/0126712 A1 May 27, 2010

(51) Int. Cl.
*E21B 34/10* (2006.01)

(52) U.S. Cl. ..... 166/375; 166/334.1; 166/183

(58) Field of Classification Search ..... 166/373, 166/375, 183, 321, 320, 334.1, 334.2, 332.8, 166/72, 73
See application file for complete search history.

(56) References Cited

U.S. PATENT DOCUMENTS

| | | | | | |
|---|---|---|---|---|---|
| 2,831,539 | A | * | 4/1958 | En Dean et al. | 166/73 |
| 2,974,922 | A | | 3/1961 | Keithahn | |
| 3,313,350 | A | * | 4/1967 | Page, Jr. | 166/374 |
| 3,351,133 | A | * | 11/1967 | Clark, Jr. et al. | 166/53 |
| 3,662,824 | A | * | 5/1972 | Page, Jr. | 166/72 |
| 3,830,306 | A | * | 8/1974 | Brown | 166/53 |
| 3,948,318 | A | * | 4/1976 | Page, Jr. | 166/323 |
| 4,047,564 | A | * | 9/1977 | Nix et al. | 166/72 |
| 4,239,083 | A | | 12/1980 | Silberman et al. | |
| 4,258,787 | A | | 3/1981 | Amancharla | |
| 4,271,903 | A | * | 6/1981 | Slagle et al. | 166/129 |
| 4,281,858 | A | | 8/1981 | Bowyer | |
| 4,285,533 | A | | 8/1981 | Silberman et al. | |
| 4,372,392 | A | * | 2/1983 | Barrington et al. | 166/373 |
| 4,373,584 | A | | 2/1983 | Silberman | |
| 4,383,578 | A | | 5/1983 | Baker | |
| 4,445,572 | A | | 5/1984 | Fineberg et al. | |
| 4,453,599 | A | * | 6/1984 | Fredd | 166/374 |
| 4,977,957 | A | | 12/1990 | Pringle | |
| 5,564,501 | A | | 10/1996 | Strattan et al. | |
| 5,826,657 | A | * | 10/1998 | Ringgenberg | 166/336 |
| 5,894,890 | A | * | 4/1999 | Garcia-Soule et al. | 166/356 |
| 6,540,025 | B2 | * | 4/2003 | Scott et al. | 166/355 |
| 6,957,703 | B2 | | 10/2005 | Trott et al. | |

OTHER PUBLICATIONS

Raulins, G.M., "Safety by Down-Hole Well Control", Journal of Petroleum Technology, Mar. 1972, 263-271.
Gano, J.C., "Differential Sensing Direct-Control Gas Storage Well Safety Valve", SPE 19086, Jun. 1989, 287-294.
Gano, J.C., et al., "New Direct-Control Gas Storage Safety Valve", SPE 26903, Nov. 1993, 139-147.

(Continued)

*Primary Examiner* — Shane Bomar
*Assistant Examiner* — Kipp Wallace
(74) *Attorney, Agent, or Firm* — Steve Rosenblatt

(57) ABSTRACT

A downhole tool has housing components that are relatively movable. One of the components is supported downhole while a control line provides fluid pressure to move the other housing component relative to the supported component to put the tool in a first position. Loss of control line pressure allows the weight of tubulars bearing on the upper housing or rods to move it to put the tool in another position. The tubing weight overcomes the hydrostatic pressure in the control line even when there is no applied pressure in the control line to cause relative housing or rods movement to operate a tool. In that sense the tool can be fail safe to shut off flow, for example, on loss of control line pressure while reducing or elimination the need for a large return spring to offset hydrostatic pressure.

16 Claims, 2 Drawing Sheets

OTHER PUBLICATIONS

Lesimer, Dwayne, "A System Approach to Annular Control for Total Well Safety", SPE 26740, May 1993, 11-17.

Pearce, K.A., et al., "World's First Annular Safety Valve for Dual Concentric Water Injection", SPE/IADC 105489, Feb. 2007, 1-7.

* cited by examiner

TUBING WEIGHT OPERATION FOR A DOWNHOLE TOOL

FIELD OF THE INVENTION

The field of this invention is downhole tools and more specifically tools that use the potential energy of tubing weight for operation in at least one mode with the preferred embodiment being a downhole control line operated valve or sleeve that fails safe closed with tubing weight on loss of control line pressure.

BACKGROUND OF THE INVENTION

Tubing safety valves are used to close the tubing string in a well to control flow. Typically these valves have a disc that rotates 90 degrees against a seat that surrounds the flow path to close the valve. The disc, also known as a flapper, is forced open by a tube, known as a flow tube, which is hydraulically operated with pressure delivered from the surface to the housing of the valve via a control line that runs along the side of the tubing string. Control line pressure usually pushes the flow tube down against the flapper and the flapper gets behind the flow tube as it swings 90 degrees away from its seat. The control line pressure acts on an annular piston or one or more rod pistons that are operably connected to the flow tube. Downward movement of the flow tube is resisted by a closure spring so that in the normally open position for the flapper, the spring is compressed when the flapper is behind the downwardly displaced flow tube. As long as control line pressure is maintained the flow tube doesn't move and the valve stays open with the flapper behind the flow tube. When control line pressure is removed or otherwise lost, the closure spring has to be sized to overcome the hydrostatic pressure in the control line or annulus even when there is no applied pressure in the control line so that the flow tube can be biased up and a pivot spring on the flapper pivot connection can rotate the flapper 90 degrees to its seat to close the valve.

In very deep applications, the hydrostatic pressure in the control line can be very high and that requires a fairly large closure spring. Alternatives that have been used have their own drawbacks. For example a two line control system can be used so that hydrostatic pressure from the control lines cancels out on the annular or rod piston that has to move to actuate the flow tube. Sometimes there are space limitations and there is the time required to run another line and the added risks of damage to the control lines during installation. Another alternative is to provide a pre-charged housing chamber with enough gas pressure to offset the hydrostatic pressure in the control line so the closure spring only needs to overcome valve friction and the weight of the flow tube so that the valve can close on loss of control line pressure. However, providing pressurized chambers that can tolerate fairly high pressures depending of the operating depth of the valve make the valve more expensive to build and usually require many more seals and an intricate system of passages that can pose a greater risk of leakage that can undermine the operation of the valve.

Downhole safety valves that are the flapper type are shown in U.S. Pat. No. 6,957,703 and ball type downhole valve that apply an eccentric force to the ball to turn it 90 degrees between the open and the closed position are shown in U.S. Pat. No. 4,293,038.

In the realm of tools that are surface operated with control line pressure the present invention seeks to reduce or even eliminate the need for a closure spring or springs by taking advantage of available tubing weight. Usually there is a support further downhole from the downhole tool in the form of a packer or anchor, for example. In such cases the control line pressure can be used to lift at least a portion of the string above the valve sleeve housing where the housing is built to tolerate relative movement between components. An expansion joint can also be optionally used above the tool so that only the requisite weight of tubing above the valve housing is lifted. Alternatively in wells that experience a large range of temperatures, the thermal effects of temperature change can be addressed with such a bellows or expansion joint. Upon failure of control line pressure for any reason, the weight of the tubing can come into play and operate the downhole tool. The applications to the type of downhole tool are varied and those skilled in the art will more fully appreciate the scope of the invention from a review of the description of the preferred embodiment and the associated drawings that appear below while recognizing that the full scope of the invention is found in the claims below.

SUMMARY OF THE INVENTION

A downhole tool has housing components that are relatively movable. One of the components is supported downhole while a control line provides fluid pressure to move the other housing component relative to the supported component to put the tool in a first position. Loss of control line pressure allows the weight of tubulars bearing on the upper housing or rods to move it to put the tool in another position. The tubing weight overcomes the hydrostatic pressure in the control line even when there is no applied pressure in the control line to cause relative housing or rods movement to operate a tool. In that sense the tool can be fail safe to shut off flow, for example, on loss of control line pressure while reducing or elimination the need for a large return spring to offset hydrostatic pressure.

DETAILED DESCRIPTION OF THE PREFERRED EMBODIMENT

Figure 1:
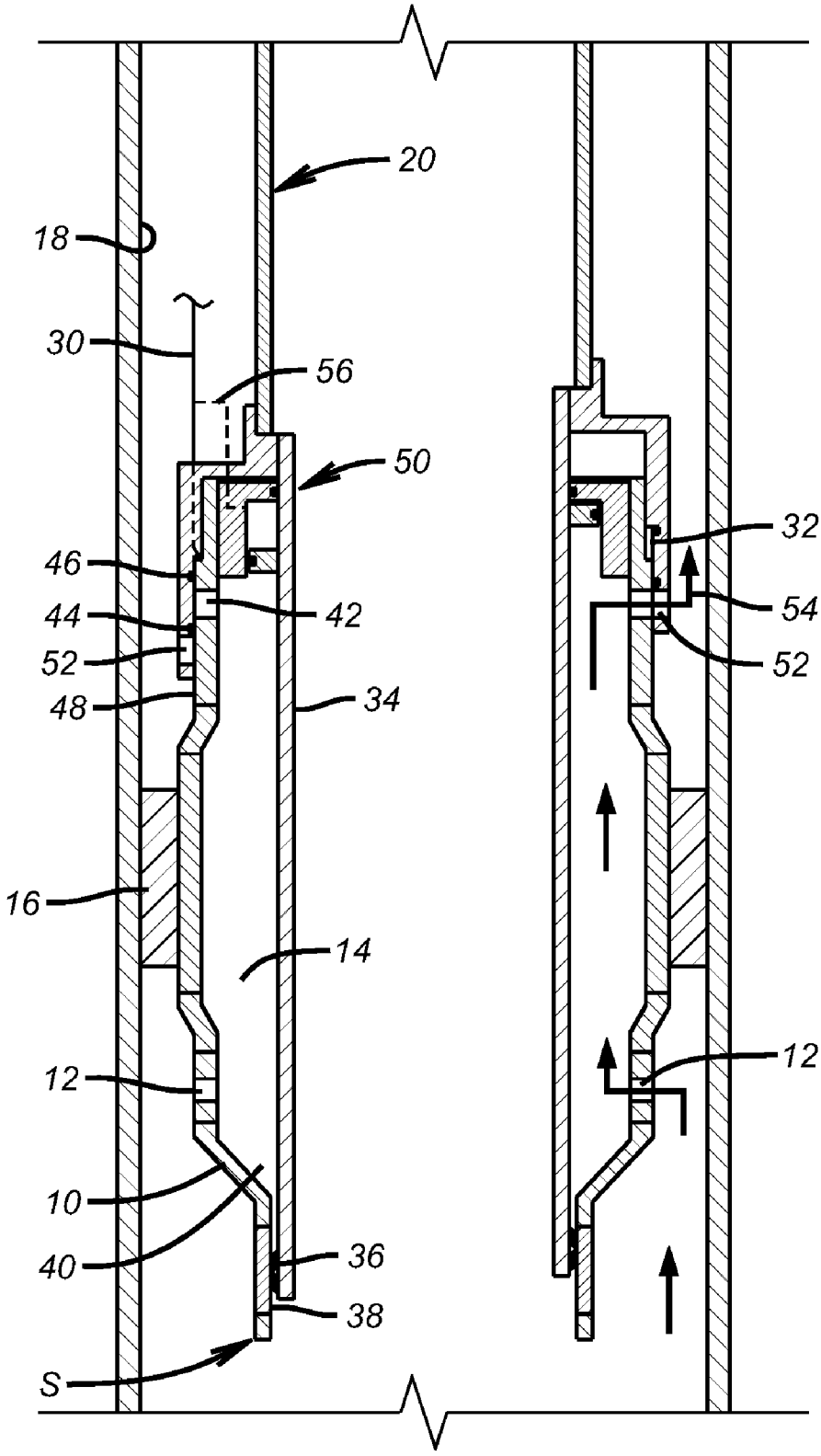
FIG. 1 is a split elevation view of a valve of the present invention in the closed position on the left and the open position on the right.
Figure 2:
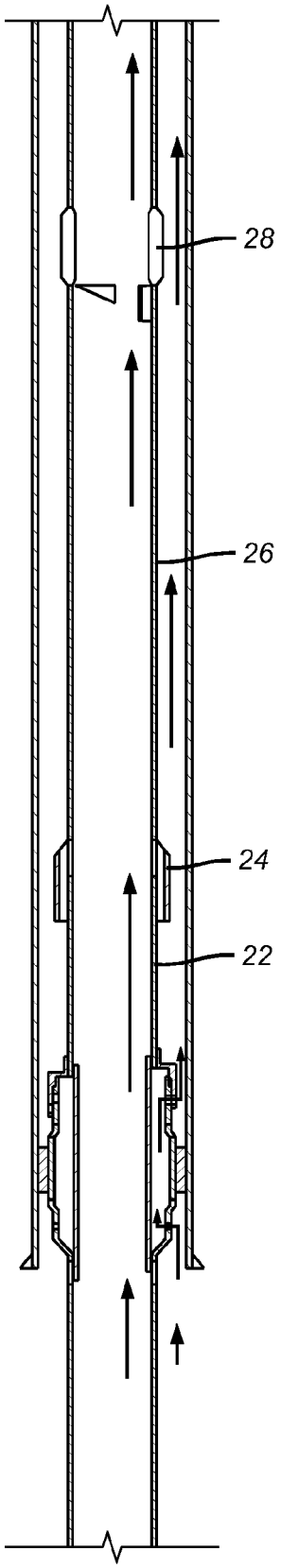
FIG. 2 is shows the valve of FIG. 1 in a tubular system where the valve is used as a packer bypass and the tubing above has an expansion joint.

One embodiment of the present invention is shown in FIG. 1. A lower housing 10 has a series of inlet ports 12 that lead to an annular space 14. The lower housing 10 is supported fixedly downhole by an anchor or packer or plug schematically illustrated as S. In the FIG. 1 illustration the lower housing 10 is part of a packer that has a sealing element 16 shown in a set position against an outer tubular 18. An upper housing 20 has a series of tubulars 22, see FIG. 2, above it leading up to an optional expansion joint 24. From there and going uphole, a string 26 extends to a subsurface safety valve 28 and from there a string 30 continues to the surface, not shown. Referring back to FIG. 1 a control line 30 runs from the surface and connects to a variable volume sealed chamber 32. Chamber 32 grows in volume on the right side of FIG. 1 when control line pressure is delivered to it. The upper housing 20 has a sleeve 34 that moves with it. At the lower end of sleeve 34 is a seal 36 that rides with respect to the stationary lower housing 10. A polished surface 38 is provided on the lower housing 10 so that the seal 36 can ride on it to maintain the sealed integrity of the annular space 14 at its lower end 40.

The lower housing 10 has a port 42 that is covered by the upper housing 20 and straddled by seals 44 and 46 on the upper housing 20 that ride on polished surface 48 on the lower housing 10. Thus, on the left side of FIG. 1 the upper end 50 of annular space 14 is also closed precluding any bypass flow around the set sealing element 16. It should be understood that the mechanism for setting the sealing element is omitted as the construction of a packer assembly is itself not the focus of the invention in the described embodiment that focuses on a valve design that happens to be a bypass for a known packer design. In the closed position on the left side of FIG. 1 the port 52 is offset from port 42 and isolated from it by seals 44 and 46.

When pressure is applied to the control line 30, the lower housing 10 is anchored at S and it doesn't move. The chamber 32 gets bigger by displacing upper housing 20 against the expansion joint 24. Those skilled in the art will realize that the expansion joint 24 is optional and it can have a variety of known designs such as a bellows or concentric tubes that are slidably mounted while holding a pressure seal between them. The weight of string 22 leading to the expansion joint 24 is calculated to exceed the hydrostatic pressure in line 30 as well as seal friction while a factor of safety is added for good measure so that upon failure of applied pressure in control line 30 there is enough movable string weight in string 22 up to the expansion joint 24 to move the upper housing 20 down with respect to the stationary lower housing 10 so that the closed position on the left side of FIG. 1 can be resumed. Application and holding of sufficient pressure in line 30 to lift string 22 results in alignment of ports 42 and 52 and bypass flow indicated by arrows 54 can go between ports 12 and 52 in either direction.

Reduced to simple terms a downhole tool can have relatively movable components whose movement in one direction responsive to an applied force creates a potential energy that can later be deployed to put the tool in a different position. The applied force can come from a control line or a pressurized annulus or a pressurized internal passage which itself can be part of the tubing string passage or a chamber charged at the surface. Conceptually the failure of the force that enables the stored potential energy to exist allows the potential energy to be converted to kinetic energy to operate a tool. The potential energy comes from available string weight adjacent a movable component of the downhole tool, which can be its outer housing or an internal component. The release of the potential energy into kinetic energy creates relative movement to operate the tool. The tool can be a valve that goes to a failsafe position in response to the movement made possible by employing tubing weight. As an alternative, when used in tandem with a closure member that holds the weight of the fluid in the tubing above the downhole tool that is operable by string weight, the combined weight of well fluid and string weight can be deployed. Alternatively, as indicated by schematic line 56 the hydrostatic pressure can be redirected with a pressure switch to another chamber so that on sensing low pressure in control line 30 the hydrostatic force is redirected to another chamber to push upper housing 20 toward lower housing 10 instead of chamber 32 where hydrostatic pressure will oppose return movement of upper housing 20 toward lower housing 10 on loss of control line pressure. Conversely if control line pressure is resumed it can be directed back to chamber 32 to raise the string 22 to resume normal operation.

Figure 3:
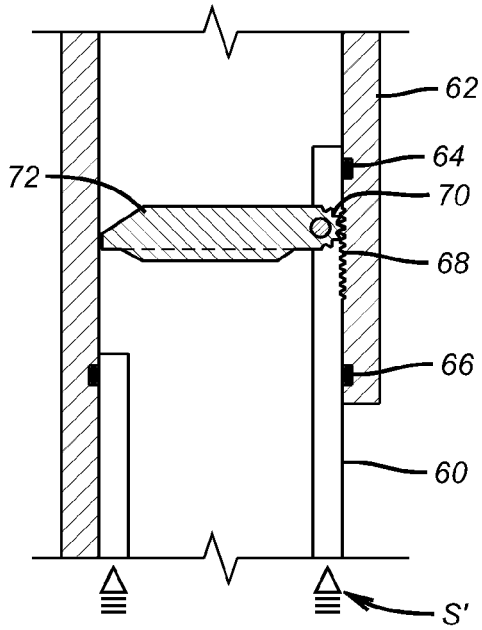
FIG. 3 shows an application to a tubing safety valve that uses a flapper operated by a rack and pinion actuated by relative movement of the housing components.

FIG. 3 illustrates the concept in a flapper type tubing safety valve. The lower housing 60 is connected to the movable upper housing 62 with seals 64 and 66. The upper housing 62 can have a rack 68 while the stationary lower housing held downhole as schematically shown with S' has a pinion 70 coupled with a flapper 72. The tubing safety valve 28 in FIG. 2 can be of this design. Those skilled in the art will realize that a ball type safety valve can have an offset actuator that is energized by relative movement of housing components such as 60 and 62. Safety valve 28 can be of such a design and can be located alternatively below the expansion joint 24.

While the preferred embodiment is most useful in vertical wells to take full advantage of gravity and string weight, some degree of offset is possible as long as there is enough weight available to overcome any friction force from the offset. To some extent centralizers or vibrators can be employed to reduce such friction forces caused by hole deviation from vertical.

The above description is illustrative of the preferred embodiment and many modifications may be made by those skilled in the art without departing from the invention whose scope is to be determined from the literal and equivalent scope of the claims below.

We claim:

1. A subterranean tool assembly mounted to a tubular string, comprising:

at least one tool comprising at least a first and a second relatively movable components, at least one tubular defining an annular space around itself whose weight bears on one of said components while another component is supported downhole;

said components held in a first relative position responsive to an applied force to the tool which opposes the weight of said tubular to put the tool in a first operating position and said components responding to a removal of the applied force by using the weight of said tubular to assume a second operating position;

said components are in contact with each other and their relative movement opens and closes a flow passage;

said flow passage formed in a sealed annular space in said housing defined by said components said flow passage, when open, allowing a packer blocking said surrounding annular space to be bypassed.

2. The assembly of claim 1, wherein:

said applied force is delivered to a variable volume chamber in the tool through a control line.

3. The assembly of claim 1, wherein:

said applied force is delivered through a passage in the tool in flow communication with a passage in said tubular.

4. The assembly of claim 1, wherein:

the weight of fluid in said tubular as well as the weight of said tubular bear on one of said components.

5. The assembly of claim 1, wherein:

said components define said flow passage.

6. The assembly of claim 5, wherein:

said components define a first variable volume chamber between them.

7. The assembly of claim 6, further comprising:

a control line in fluid communication with said first variable volume chamber to deliver pressure thereto to overcome the weight of said tubular to cause relative movement of said components by raising said tubular.

8. The assembly of claim 1, wherein:

said components comprise a housing for a subsurface safety valve and the relative movement of said components opens and closes a closure member in a passage through said housing.

9. The assembly of claim 8, wherein:

said closure member is a flapper, a ball or a plug responsive to relative component movement to rotate between an open and a closed position.

10. The assembly of claim 7, wherein:

a second variable volume chamber selectively in exclusive communication with said control line upon reduction of pressure in said control line to a predetermined value, whereupon hydrostatic pressure in said control line in said second variable volume chamber acts in concert with the weight of said tubular.

11. The assembly of claim 7, wherein:

the hydrostatic/hydraulic pressure in said control line is overcome with the weight of the tubular.

12. The assembly of claim 11, wherein:

the hydrostatic/hydraulic pressure in said control line is exclusively overcome with the weight of the tubular.

13. The assembly of claim 1, wherein:

said at least one tool comprises two tools one of which is a tubing safety valve mounted to said tubular and the other comprising said packer with an internal bypass for selective annulus flow around said packer and said tubing safety valve.

14. The assembly of claim 13, further comprising:

an expansion joint mounted to said tubular to limit the number of tubulars whose weight bears on one of said components.

15. A downhole tool assembly mounted to a tubular string, comprising:

at least one tool comprising at least a first and a second relatively movable components, at least one tubular whose weight bears on one of said components while another component is supported downhole;

said components held in a first relative position responsive to an applied force to the tool which opposes the weight of said tubular to put the tool in a first operating position and said components responding to a removal of the applied force by using the weight of said tubular to assume a second operating position;

said components are in contact with each other and their relative movement opens and closes a flow passage;

said components define said flow passage;

said components define a first variable volume chamber between them;

a control line in fluid communication with said first variable volume chamber to deliver pressure thereto to overcome the weight of said tubular to cause relative movement of said components by raising said tubular;

said components define a housing with a through passage in fluid communication with said tubular and an external packer to selectively seal an annular space around said housing;

said flow passage formed in a sealed annular space in said housing defined by said components and located around said through passage said flow passage, when open due to pressure in said first variable volume chamber, allowing said packer blocking a surrounding annulus to be bypassed.

16. The assembly of claim 15, wherein:

said through passage defined by a sleeve mounted to the component that receives the weight of said tubular and said sleeve is sealed when sliding relatively to the other component.

* * * * *